US005627507A

United States Patent [19]

Morbitzer et al.

[11] Patent Number: 5,627,507

[45] Date of Patent: May 6, 1997

[54] TEMPERATURE CONTROL DEVICE WITH A SPRING-BIASED STEM AND A SWITCH SPRING OF BRIDGE-LIKE CONFIGURATION

[75] Inventors: Hans-Peter Morbitzer, Langenlebarn; Peter Sekira, Vienna, both of Austria

[73] Assignee: Electrovac, Fabrikation elektronischer Spezialartikel Gesellschaft m.b.H., Klosterneuburg, Austria

[21] Appl. No.: 350,218

[22] Filed: Dec. 5, 1994

[30] Foreign Application Priority Data

Dec. 3, 1993 [AT] Austria ..... A2453/93

[51] Int. Cl.[6] ..... H01H 37/48

[52] U.S. Cl. ..... 337/394; 337/382

[58] Field of Search ..... 337/236, 382, 337/394, 300

[56] References Cited

U.S. PATENT DOCUMENTS 3,508,020 4/1970 Culver .

4,695,816 9/1987 Essig et al. ..... 337/394

FOREIGN PATENT DOCUMENTS

| | | |
|---|---|---|
| 0279368A2 | 8/1988 | European Pat. Off. . |
| 3423086A1 | 1/1985 | Germany . |
| 691223 | 5/1953 | United Kingdom . |
| 1003519 | 9/1965 | United Kingdom . |
| 2031228 | 4/1980 | United Kingdom . |

*Primary Examiner*—Leo P. Picard
*Assistant Examiner*—Jayprakash N. Gandhi
*Attorney, Agent, or Firm*—Henry M. Feiereisen

[57] ABSTRACT

A temperature control device includes; a spring-biased stem guided in a pipe and having a temperature expansion coefficient which is different from the temperature expansion coefficient of the pipe, with the stem acting via a plunger and a switch assembly upon a switching contact. The switch assembly includes a switch spring of bridge-like configuration which is secured to a backing spring mounted to a base plate of the housing and preferably includes a raised central part for support of the plunger.

14 Claims, 2 Drawing Sheets

TEMPERATURE CONTROL DEVICE WITH A SPRING-BIASED STEM AND A SWITCH SPRING OF BRIDGE-LIKE CONFIGURATION

BACKGROUND OF THE INVENTION

The present invention refers to a temperature control device.

A conventional temperature control device includes a stem which is guided within a pipe and has a temperature expansion coefficient which differs from the temperature expansion coefficient of the pipe. The stem is acted upon by a spring and actuates a switching contact via a plunger and a switch spring.

Temperature control devices of this type are generally provided with a switch spring which is bent in an essentially U-shaped manner for opening the contact. The provision of such a U-shaped spring is, however, disadvantageous because depending on its position, this spring exerts a more or less great force or force component from the side toward the longitudinal axis of the stem onto the plunger arranged between the stem and the spring. This may cause movement variations of the plunger in particular when the plunger carries out large strokes, and thus may adversely affect the accuracy of the operation of the temperature control device.

SUMMARY OF THE INVENTION

It is an object of the present invention to provide an improved temperature control device obviating the aforestated drawbacks.

In particular, it is an object of the present invention to provide an improved temperature control device by which the spring is prevented from exerting a force laterally in direction to the longitudinal axis of the stem upon the plunger.

These objects and others which will become apparent hereinafter are attained in accordance with the present invention by providing a spring assembly with a switch spring in form of a bridge, with the plunger being supported by a central part of the switch spring.

The bridge-shaped configuration of the switch spring results in a spring force which acts parallel in the area of support of the plunger so that the switch spring is prevented from exerting a force or movement from the side in direction to the longitudinal direction of the stem, as experienced with substantially U-shaped springs of known temperature control devices.

Preferably, the central part of the switch spring is raised or projects relative to the lateral pads in direction of the plunger.

According to another feature of the present invention, the spring assembly is incorporated inside a housing and further includes a backing spring for supporting the bridge-shaped switch spring. Preferably, the; backing spring is of arched configuration and has a central section which is fixed to a base plate of the housing. By supporting the switch spring in this manner, the spring characteristic of the spring-biased stem will not be adversely affected because of possible uneven frictional conditions through transverse movement during engagement of the lateral ends of the bridge-shaped spring at their supports. Thus, the temperature control device responds in a very precise manner according to the provided characteristic, and a respectively small hysteresis is ensured.

Moreover, by dividing the spring assembly in a bridge-shaped switch spring and a backing spring, a reduction of the spring rate and thus an improved adjustment of the required and maximum prevailing spring forces is attained, with the base plate ensuring in a simple manner a precise positioning and stabilization of the spring assembly in the housing.

According to another feature of the present invention, the bridge-shaped switch spring is provided with ends which are bent to engage over the ends of the backing spring. This ensures a very secure support of the plunger upon the switch spring. Preferably, the bent ends are provided with receptacles for receiving tabs on the edges of the backing spring to attain a secure attachment of the switch spring to the backing spring.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
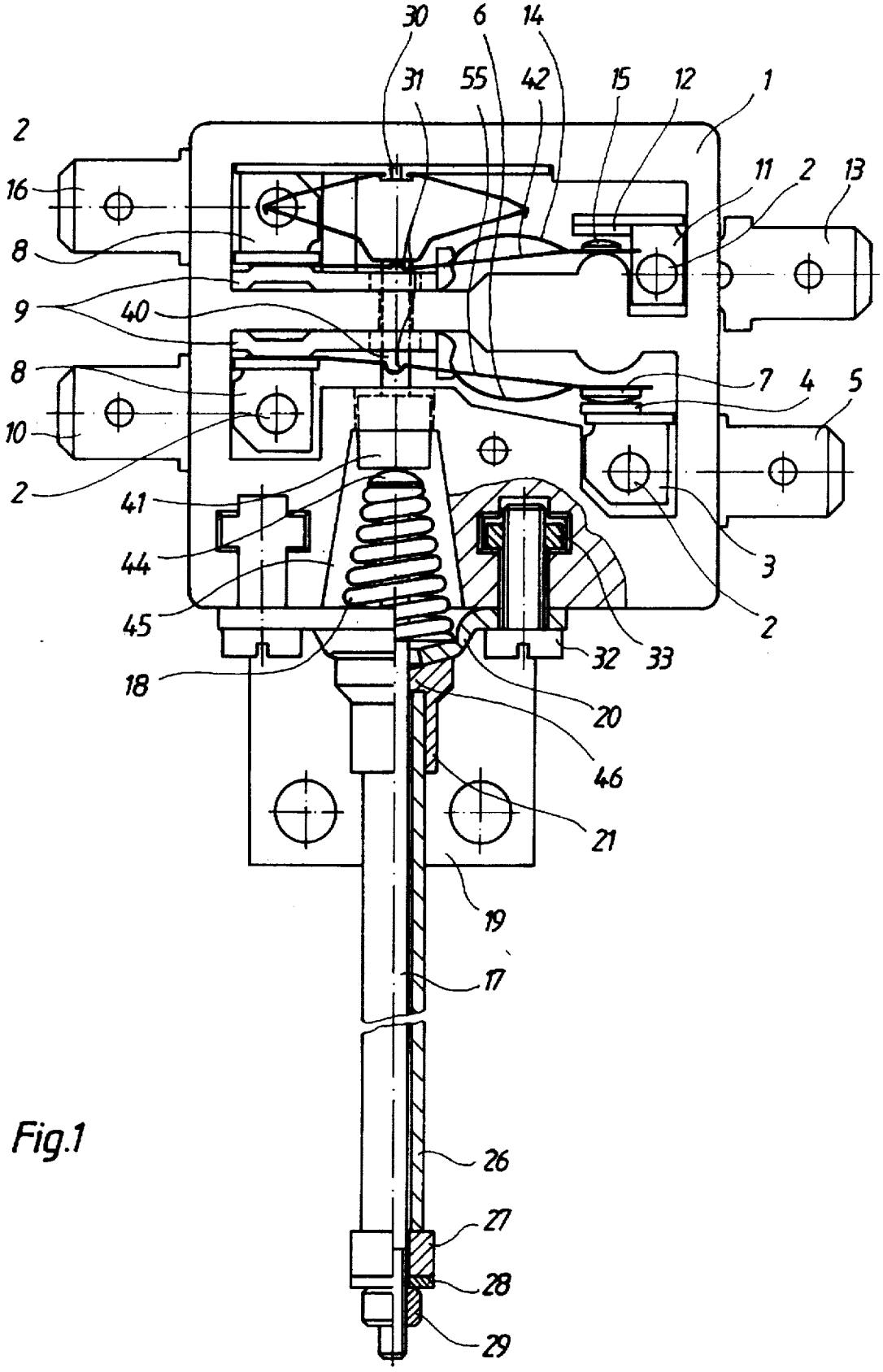
FIG. 1 a partially sectional view of a temperature control device according to the present invention, with the cover being removed.

Throughout all the Figures, the same or corresponding elements are always indicated by the same reference numerals.

Turning now to the drawing, and in particular to FIG. 1, there is shown a partially sectional view of a temperature control device according to the present invention, including a housing 1 which includes an assembly plate 19 for suitable attachment of the temperature control device. FIG. 1 shows the housing 1 with removed cover to be able to illustrate the internal components of the temperature control device.

The housing 1 is provided with two fixed contacts 4, 12 mounted to contact carriers 3, 11 which are secured to the housing 1 via rivets 2 and provided with terminal lugs 5, 13 projecting laterally from one side wall of the housing 1. The fixed contacts 4, 12 cooperate with moveable contacts 7, 15 which are mounted to contact springs 42, 55. The contact springs 42, 55 are secured to contact carriers 8 which are connected via rivets 2 to the housing 1 and include terminal lugs 10, 16 projecting laterally from the other side wall of the housing 1.

The contact springs 42, 55 of the moveable contacts 7, 15 include punched out tabs 6, 14 which are retained by supports 9. The supports 9 are connected with the contact carriers 8 and the contact springs 42, 55 and include bores for allowing passage of a ram or plunger 40 which has a head 41 resting upon a semicircular head 44 of a stem 17. The contact springs 42, 55 are also provided with bores for passage of the plunger 40 and have transverse ribs 31, with the transverse rib 31 of the contact spring 55 being engageable by the head 41 of the plunger 40, and with the transverse rib 31 of the contact spring 42 being engageable by a switch spring 43 which forms one component of a spring assembly. The other component of the spring assembly is formed by a backing spring 47 which is secured to a base plate 48 by a rivet received in a tubular rivet-like recess 30.

As shown in FIG. 1, the switch spring 43 is configured in form of a bridge and has a cup-shaped central part 53, with a flattened area 54 bearing upon the transverse rib 31 of the stem 40.

Suitably, the contact carriers 3, 11, 8, the supports 9 and the rivets 2 as well as the terminal lugs 5, 13, 10, 16 are made of electrically conducting material.

As shown in FIG. 1, the stem 17 extends vertically into the housing 1 and has in opposition to the head 41 of the plunger 40 a head portion 44 which is acted upon by a compression spring 18 disposed in a recess 45 of the housing 1. The other end of the compression spring 18 bears upon a substantially cup-shaped plate 20 which is secured by screw fasteners 32 to the housing 1 and bridges the recess 45 of the housing 1, with the screw fasteners 32 engaging threaded bores of abutments 33.

In the area of the stem 17, the plate 20 is arched and provided with a central bore for passage of the stem 17. Bearing upon the outside of the plate 20 is a sleeve 21 which is provided with an inwardly projecting circumferential rib or collar 46 for support of a pipe 26. The, opposite free end of the pipe 26 is supported by a disk 27 which is traversed by the stem 17. The stem 17 and the pipe 26 are retained by a nut 29 which is screwed onto the threaded end of the stem 17 via a washer or spacer 28 that is secured to the disk 27. By means of the spring 18, the stem 17 is drawn into the housing 1 and the pipe 26 is pressed via the disks 28, 27 against the plate 20 via the sleeve 21.

Since the pipe 26 and the stem 17 are made from materials with greatly varying temperature expansion coefficient, a temperature change will cause a movement of the head 44 of the stem 17. Since the head 44 of the stem 17 bears upon the plunger 40, a movement by the head 44 of the stem 17 is transmitted to the plunger which thus acts upon the flattened area 54 of the central part 53 of the bridge-shaped switch spring 43. Thus, the moveable contact 15 is pressed by the contact spring 42 against the fixed contact 12 because the plunger 40 pushes the switch spring 43 via the arched backing spring 47 against the base plate 48 so that the transverse rib 31 of the contact spring 42 of the moveable contact 15 becomes disengaged from its support with the switch spring 43, at which time the prestress of the contact spring 42 pushes the moveable contact 15 against the fixed contact 12.

When the head 44 of the stem 17 travels a certain distance, the head 41 of the plunger 40 is pushed against the transverse rib 31 of the contact spring 55 so that the moveable contact 7 becomes disengaged from the fixed contact 4.

Figure 2:
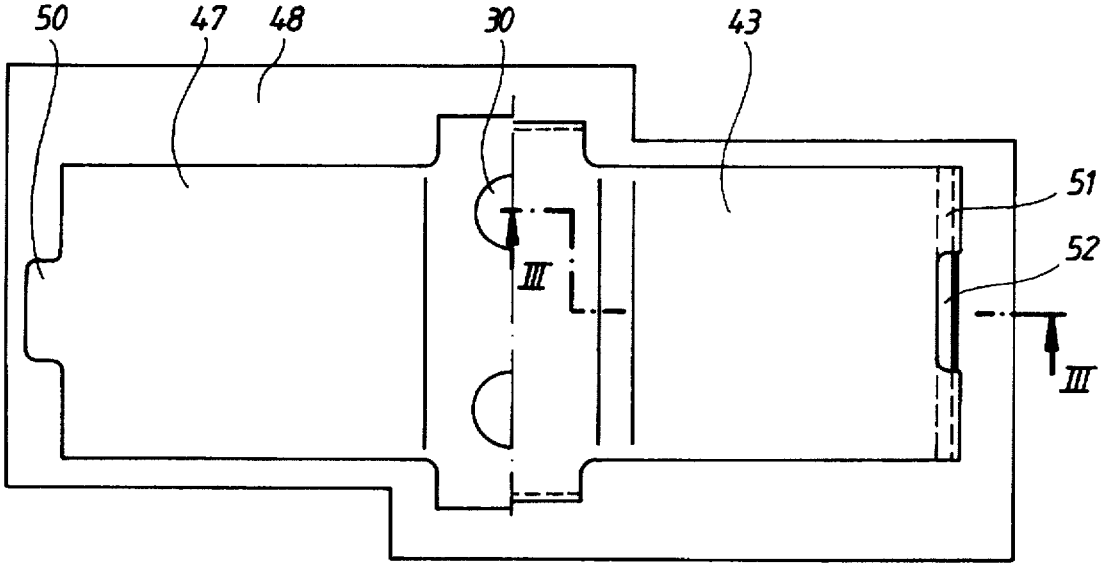
FIG. 2 a top view of a spring assembly for use in the temperature control device of FIG. 1, with the bridge-shaped switch spring being omitted on the left-hand half.
Figure 3:
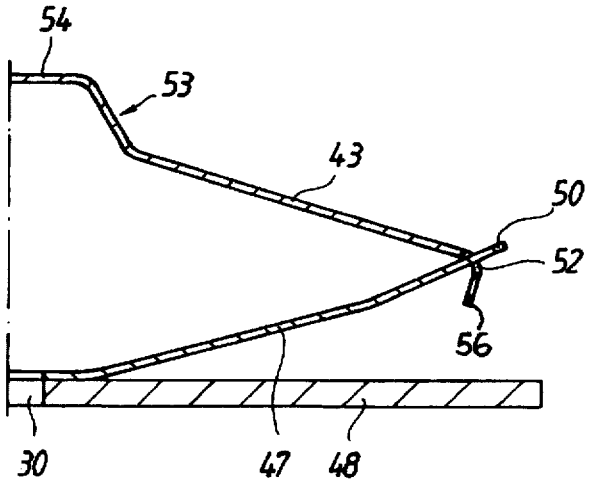
FIG. 3 is a sectional view of the spring assembly taken along the line III—III in FIG. 2.

Turning now to FIG. 2, there is shown a top view of the spring assembly for use in the temperature control device, with the bridge-shaped switch spring 43 being omitted on the left side. The backing spring 47 is provided at its lateral end with projecting tabs 50 which are received in slots or bores 52 of the switch spring 43 when assembling together the springs 43, 47 to form the spring assembly. As best seen in FIG. 3, each lateral end of the switch spring 43 is bent to define an elevated extremity 56 for accommodating the bore 52. In this manner, not only a simple assembly is attained but also the springs 43, 47 mutually secure each other in position. Instead of a bore 52, each elevated extremity 56 of the switch spring 43 may also include an outwardly open recess for supporting the backing spring 47. This configuration is especially advantageous when the mutual hold between the switch spring 43 and the backing spring 47 is of less importance.

As alternative, it is certainly within the scope of the present invention to form the backing spring 47 with elevated ends which respectively have a bore or recess for receiving the ends of the switch spring 43.

While the invention has been illustrated and described as embodied in a temperature control device, it is not intended to be limited to the details shown since various modifications and structural changes may be made without departing in any way from the spirit of the present invention.

What is claimed as new and desired to be protected by Letters Patent is set forth in the appended claims:

1. A temperature control device, comprising:

a housing having a switching contact; and actuation means for operating said contact, said actuation means including a pipe having a temperature expansion coefficient, a spring-biased stem guided in said pipe and having a temperature expansion coefficient differing from the temperature expansion coefficient of said pipe, a plunger operatively connected to said stem and a spring assembly cooperating with said plunger, said spring assembly including a switch spring in form of a bridge for actuation of said contact, said switch spring having a central area which supports said plunger and exhibiting lateral areas extending from said central area, said central area being raised relative to the lateral areas of said switch spring.

2. The temperature control device of claim 1 wherein said switch spring has lateral areas extending from said central area, said central area being raised relative to the lateral areas of said switch spring.

3. The temperature control device of claim 1 wherein said spring assembly includes a backing spring which has a central area and supports said switch spring, said housing having a base plate for attachment of said central area of said backing spring.

4. The temperature control device of claim 3 wherein said backing spring is arched.

5. The temperature control device of claim 1 wherein said backing spring has raised ends, said switch spring being secured to said raised ends of said backing spring.

6. The temperature control device of claim 1 wherein said switch spring has ends, each of which being bent at an angle for engaging over a respective end of said backing spring.

7. The temperature control device of claim 6 wherein each of said ends of said switch spring is provided with a receptacle; for tabs secured to the ends of said backing spring.

8. The temperature control device of claim 1 wherein said central part of said spring is essentially flat.

9. A temperature control device, comprising:

a housing having a switching contact; and actuation means for operating said contact, said actuation means including a pipe having a temperature expansion coefficient, a spring-biased stem guided in said pipe and having a temperature expansion coefficient differing from the temperature expansion coefficient of said pipe, a plunger operatively connected to said stem and a spring assembly cooperating with said plunger, said spring assembly including a switch spring provided in form of a bridge for actuation of said contact, said switch spring having a central area which supports said plunger, and a backing spring which has a central area and supports said switch spring, said housing having a base plate for attachment of said central area of said backing spring.

10. The temperature control device of claim 9 wherein said backing spring is arched.

11. The temperature control device of claim 2 wherein said backing spring has raised ends, said switch spring being secured to said raised ends of said backing spring.

12. The temperature control device of claim 2 wherein said switch spring has ends, each of which being bent at an angle for engaging over a respective end of said backing spring.

13. The temperature control device of claim 12 wherein each of said ends of said switch spring is provided with a receptacle for tabs secured to the ends of said backing spring.

14. The temperature control device of claim 9 wherein said central part of said spring is essentially flat.

* * * * *

UNITED STATES PATENT AND TRADEMARK OFFICE

CERTIFICATE OF CORRECTION

PATENT NO. : 5,627,507

DATED : May 6, 1997

INVENTOR(S) : Hans-Peter Morbitzer & Peter Sekira

It is certified that error appears in the above-indentified patent and that said Letters Patent is hereby corrected as shown below:

Claim 2, line 1, change "1" to --9--.

Signed and Sealed this

Sixteenth Day of September, 1997

*Attest:*

BRUCE LEHMAN

*Attesting Officer*

*Commissioner of Patents and Trademarks*